US006415577B1

(12) United States Patent
Curtis

(10) Patent No.: US 6,415,577 B1
(45) Date of Patent: Jul. 9, 2002

(54) CORRUGATED WEB BEAM CONNECTED TO A TOP TUBE AND BOTTOM TUBE

(75) Inventor: Jerry W. Curtis, Fort Collins, CO (US)

(73) Assignee: EagleSpan Steel Structures, Inc., Loveland, CO (US)

( * ) Notice: Subject to any disclaimer, the term of this patent is extended or adjusted under 35 U.S.C. 154(b) by 0 days.

(21) Appl. No.: 09/677,002

(22) Filed: Sep. 29, 2000

(51) Int. Cl.[7] ..... E04C 3/30
(52) U.S. Cl. ..... 52/729.3; 52/745.19
(58) Field of Search ..... 52/729.1, 729.2, 52/729.3, 745.17, 745.19, 690, 376

(56) References Cited

U.S. PATENT DOCUMENTS

| | | | | |
|---|---|---|---|---|
| 1,523,106 A | | 1/1925 | Dornier | |
| 2,007,898 A | | 7/1935 | Ragsdale | 189/37 |
| 2,108,795 A | * | 2/1938 | Budd | 219/107 |
| 2,514,607 A | | 7/1950 | McLean | 189/37 |
| 3,686,819 A | | 8/1972 | Atkinson | 52/693 |
| 4,490,958 A | | 1/1985 | Lowe | 52/634 |
| 5,079,884 A | | 1/1992 | Menchetti | 52/241 |
| 5,417,022 A | * | 5/1995 | Ritchie | 52/309.13 |
| 5,553,437 A | | 9/1996 | Navon | 52/729.1 |
| 5,787,559 A | | 8/1998 | Dean | 29/33 |
| 5,842,318 A | | 12/1998 | Bass et al. | 52/653.1 |

OTHER PUBLICATIONS

Two (2) drawings dated Feb. 1998, showing prior EagleSpan Steel Structure, Inc. beam sold in 1998.

Arsicault, M. and Lalleman, J.P., "Joint Tracking with Self–Teaching System," *Welding Journal*, Dec., 1990.

Peterson, J.M. and Cord, M.E., "Investigation of the Buckling Strength of Corrugated Webs in Shear," *Technical Note D–424*, Washington, D.C. 1960.

Rothwell, A., "The Shear Stiffness o Flat Side Corrugated Webs," *Aeronautical Quarterly*, vol. 19, Pt.3, 1968, pp. 224–234.

Sherman, D. and Fisher, J., "Beams With Corrugated Webs," *Proceedings of the First Specialty Conference on Cold–Formed Steel Structures*, University of Missouri–Rolla, 1971, pp. 198–204.

Libove, C., "On the Stiffness, Stress, and Buckling of Corrugated Shear Webs," *Proceedings of the Second Specialty Conference on Cold Formed Steel Structures*, University of Missouri–Rolla, 1973, pp. 259–301.

Easley, J.T., "Buckling Formulas for Corrugated Metal Shear Diaphragms," *Journal of the Structural Division*, ASCE, St. 7, 1975, pp. 1403–1417.

Wu, L.H. and Libove C., "Curvilinearly Corrugated Plates in Shear," *Journal of the structural Division*, ASCE, St. 11, 1975, pp. 2205–2222.

Hussain, M.I. and Libove, C., "Stiffness tests of Trapezoidal Corrugated Shear Webs," *Journal of the Structural Division*, ASCE, St. 5, 1977, pp. 971–987.

Harrison, J.D., "Exploratory Fatigue Tests of Two Girders with Corrugated Webs," *British Welding Journal*, 12, No. 3, 1965, pp. 121–125.

(List continued on next page.)

*Primary Examiner*—Beth A. Stephan
*Assistant Examiner*—Naoko Slack
(74) *Attorney, Agent, or Firm*—Howrey Simon Arnold & White, LLP

(57) ABSTRACT

A structural beam for use in the construction industry is described. The structural beam is comprised of a hollow top section and a hollow bottom section which are connected by one or two webs that may be corrugated. The hollow top and bottom sections may be rectangular. A corrugated web is also described having a trapezoidal shape. Also described is the combination of utilizing rectangular horizontal sections with a corrugated web to produce a structural beam that is light in weight, yet strong and fatigue resistant. Also described is a method of producing a structural beam having a corrugated web, a hollow top section, and a hollow bottom section.

38 Claims, 8 Drawing Sheets

OTHER PUBLICATIONS

Korashy, M. and Varga, J. "Comparative Evaluation of Fatigue Strength of Beams with Web Plate Stiffened in the Traditional Way and by Corrugation," *Acta Technica Academiae Scientiarum Hungaricae*, 1979, pp. 309–346.

Bergfelt, A. and Leiva–Aravena, L., "Shear Buckling of Trapezoidally Corrugated Girder Webs," *Report No. S 84:2* (ISSN 0534–0411), Department of Structural Engineering, Chalmers University of Technology, Goteborg, Sweden, 1984.

Lindner, J., "Lateral–Torsional Buckling of Beams with Trapezoidally Corrugated Webs," *Proceedings of the 4th International Colloquium on Stability of Steel Structures*, Budapest Lindner, J., "Shear Capacity of Beams with Trapezoidally Corrugated Webs and Openings", *Proceedings of the Structural Stability Research Council*, Chicago, IL, 1991, pp. 403–412.

Scheer, J. and Einsiedler, O., "Trapezstegtrager Geschweibt Endbuicht", Bericht Nr. 6203/2, Institut for Stahlbau Technischen, Universitat Braunschweig, Germany, 1993.

Hamada, M., Nakayama, K., Kakihara, M., Saloh, K., and Ohtake, F., "Development of Welded I–Beam with Corrugated Web," *The Sumitomo Search*, No. 29, 1984, pp. 75–90.

Heywood, P., "Corrugated Box–Girder Web Lowers Bridge Weight an Cost," *ENR*, Dec., 1987, 32.

Combault, J., "The Maupre Viaduct Near Charolles, France," *Proceedings of the AISC Engineering Conference*, 1988, 12.1–12.22.

Elgaaly, M., and Dagher, H., "Beams and Girders with Corrugated Webs," *Proceedings of the SSRC Annual Technical Session, Lehigh University*, 1990, pp. 37–53.

Elgaaly, M., Hamilton, R., and Seshadri, A., "Shear Strength of Beams with Corrugated Webs," *Journal of Structural Engineering*, ASCE, vol. 122, No. 4, 1996.

Elgaaly, M., Seshadri, A., and Hamilton, R., "Bending Strength of Steel Beams with Corrugated Webs," ASCE, Accepted for publication in the *Journal of Structural Engineering*, 1997.

Elgaaly, M., and Seshadri, A., "Girders with Corrugated Webs Under Partial Compressive Edge Loading," ASCE, Accepted for publication in the *Journal of Structural Engineering*, 1997.

Hamilton, R., "Behavior of Welded Girders with Corrugated Webs," a *thesis* submitted in partial fulfillment of the requirements for the degree of doctor of philosophy in civil engineering, University of Maine, 1993.

Seshadri,. A., "Behavior of Steel Built–Up Girders with Corrugated Webs," a *thesis* submitted in partial fulfillment of the requirements for the degree of doctor of philosophy in civil engineering, Drexel University, 1996.

Levia–Aravena, L., "Trapezoidally Corrugated Panels–Buckling behavior Under Axial Compression and Shear, "Division of Steel and Timber Structures, Chalmers University of Technology, Publ. 87:1, 1987.

Elgaaly, M., "Web Design Under Compressive Edge Loads," *Engineering Journal*, AISC, $4^{th}$ Qtr., 1983, pp. 153–171.

Borga Incorporated Internet page; 8 pgs.

Mohamed Elgaaly and Anand Seshadri, "Steel Built–up Girders with Trapezoidally Corrugated Webs", Engineering Journal/First Quarter/1998, vol. 35, No. 1; cover and pp. 1–11.

* cited by examiner

CORRUGATED WEB BEAM CONNECTED TO A TOP TUBE AND BOTTOM TUBE

BACKGROUND OF THE INVENTION

1. Field of the Invention

The present invention relates generally to the fields of metal working and building construction. More particularly, the invention concerns structural beams, such as I-beams, having a web that may be corrugated, interposed between two hollow plates, resulting in beams that are relatively light weight, yet strong compared to other building materials.

2. Description of Related Art

In the construction industry, beams and girders are often utilized to provide the structural strength for a variety of buildings. These beams and girders may be manufactured from metal, such as steel. It is known to utilize steel beams to construct a variety of structures like buildings, bridges, fences, ship bulkheads, truck bodies, aircraft, and mobile homes frames, to name a few.

Often, it is desired to reduce the weight and cost of manufacture of these metal beams, while concomitantly improving the strength of these metal beams. One method of increasing the strength of the metal beams is through the use of high strength steels. Use of high-strength steels allows for smaller beams to carry greater loads. However, these high-strength steels do not necessarily reduce the weight of the beams and often increase manufacturing costs.

Another method of decreasing the weight of the beam without reducing its strength is by using an I-beam. An I-beam is generally comprised of two solid metal flanges supported by a slender connecting piece or web. Thus, the beam is formed in the shape of an I. For a given strength of the beam, it is known that the I-beam is much lighter than a metal beam with a solid cross section.

To reduce the weight of beams and girders, it is customary to decrease the thickness of the webs. The thin web is connected to the solid metal flanges in a variety of ways. For instance, the web may be welded to flanges. The web may be welded on one side or both sides. Or, if a very thin web is utilized, angle iron may be used to support the connection of the web to the flanges. However, thin webs—while reducing the overall weight of the beam—are susceptible to fatigue and may buckle laterally when loaded.

Multiple attempts have been made to increase the fatigue strength and lateral stability of these I-beams with thin webs. For instance, it is standard practice to place stiffeners strategically along the length of the I-beam to laterally support the web. While the strength of such a beam is improved, and its weight remains relatively light, manufacturing costs associated with the attachments of the stiffeners makes the use of stiffeners less attractive. Further, it is known that I-beams having thin webs with stiffeners experience decreased fatigue life compared to other beams. Attachment of stiffeners may cause severe stress concentrations thus further reducing the fatigue strength of welded beams and girders.

Another method of improving the strength of these I-beams is to increase the web thickness. However, this increase in thickness is accompanied by an increase in weight.

Another method of reducing this buckling problem and increasing the strength of the I-beam is through the use of corrugated webs. It is known to provide a web that is corrugated, i.e. having alternating ridges and grooves. The corrugation may be symmetrical or asymmetrical, and may have straight or curved profiles. For example, corrugations of the shape of a sine wave are known for use with solid flanges, as are corrugations having a trapezoidal or rectangular profile for use with the solid flanges.

In general, corrugations greatly increase fatigue strength of the I-beam compared to flat webs. Further, it is known that the use of corrugations decreases the weight of the beam required to support a given load. Thus, it is known that the web thickness can be reduced by using a corrugated web while maintaining beam strength. For practical reasons and for thermal stress relief, the corrugated web may be attached to the solid flange at discrete points: e.g. bolts.

Another attempt to provide strong, yet relatively light metal beams or girders is described in U.S. Pat. No. 5,079,884 entitled "Extendible Interconnected Z-studs" to Menchetti. This patent describes the formation of Z-form metal sections having opposed flanges, and a method of interconnecting two Z-studs.

Thus, there is a need for providing girders or beams that, compared to other beams, are relatively strong and relatively light in weight. The desired beams would have a high strength-to-weight ratio, while providing lateral structural stability and resistance to bending and fatigue. There is also a need to provide structural beams that do not have sharp edges. Further, there is a need for producing these beams in a cost efficient manner, which does not necessarily include the use of stiffeners, flange braces, or difficult-to-deform materials.

SUMMARY OF THE INVENTION

A structural beam is described having a top tube, a bottom tube, and a web having a first end and a second end. The web is interposed between the top tube and the bottom tube. The first end of the web is connected to the top tube, and the second end of the web is connected to the bottom tube. In some embodiments, the top tube has a first rectangular cross section. In others, the bottom tube has a second rectangular cross section.

In some aspects, the first and second rectangular cross sections each have a wall thickness of between about ⅛ inch and about ⅞ inch. In other aspects, the first and second rectangular cross sections each have a width of between about four inches to about twelve inches and a height of between one inch and eight inches. In other embodiments, a structural beam is described in which the web comprises a corrugated web having a trapezoidal profile.

In other embodiments, a method of constructing a structural beam is described having the following steps: providing a rectangular top tube, providing a rectangular bottom tube, providing a web having a first end and a second end, attaching the first end of the web to the rectangular top tube, and attaching the second end of the web to the rectangular bottom tube such that the web is interposed between the rectangular top tube and the rectangular bottom tube.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein.

Figure 1A:
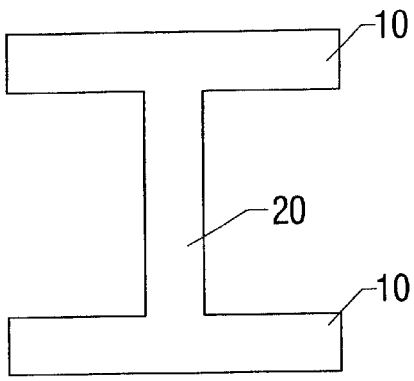
FIG. 1A (Prior Art)
FIGS. 1A–C show a prior art I-beam.

While the invention is susceptible to various modifications and alternative forms, specific embodiments have been shown by way of example in the drawings and will be described in detail herein. However, it should be understood that the invention is not intended to be limited to the particular forms disclosed. Rather, the intention is to cover all modifications, equivalents, and alternatives falling within the spirit and scope of the invention as defined by the appended claims.

DESCRIPTION OF ILLUSTRATIVE EMBODIMENTS

The following examples are included to demonstrate preferred embodiments of the invention. It should be appreciated by those of skill in the art that the techniques disclosed in the examples which follow represent techniques discovered by the inventor to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit and scope of the invention.

Illustrative embodiments of the invention are described below as they might be employed to construct a structural beam. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Further aspects and advantages of the various embodiments of the invention will become apparent from consideration of the following description and drawings. Each component shown in the following figures may be comprised of steel, stainless steel, aluminum, or other suitable material.

Figure 1B:
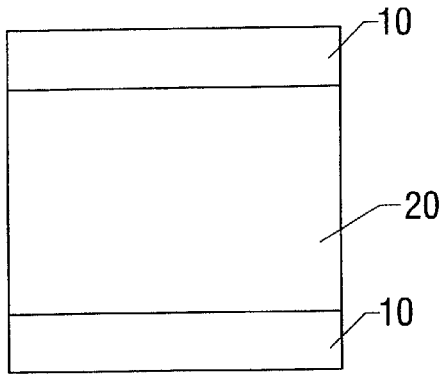
FIG. 1B (Prior Art)
Figure 1C:
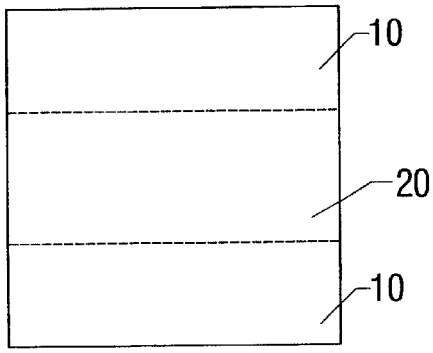
FIG. 1C (Prior Art)

FIG. 1 shows a prior art I-beam previously described. The I-beam consists of two solid flanges 10 connected by a flat web 20. FIG. 1A shows an end view of the prior art I-beam, while FIG. 1B shows a side view and FIG. 1C shows a top view of the prior art I-beam.

Figure 2:
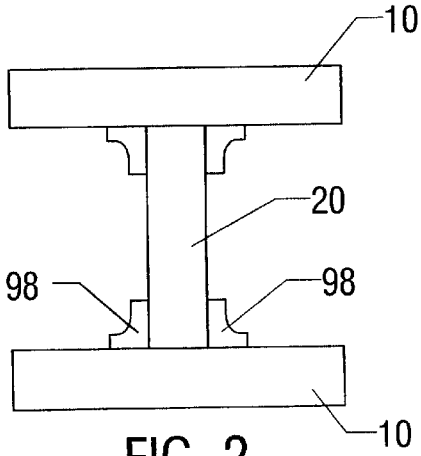
FIG. 2 (Prior Art)
FIG. 2 shows a prior art I-beam having angle iron.

FIG. 2 shows an end view of a prior art I-beam in which the connection between the solid flanges 10 and the flat web 20 is formed via angle iron 98. While angle iron 98 provides additional strength, it also can add to the weight and adds manufacturing costs to the production of an I-beam.

Figure 3:
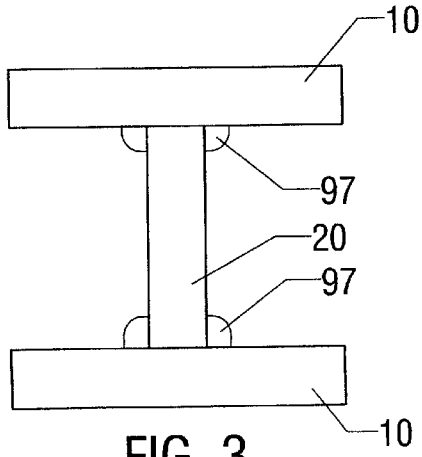
FIG. 3 (Prior Art)
FIG. 3 shows a prior art I-beam having attachment material.

FIG. 3 shows an end view of a prior art I-beam having the solid flanges 10 connected to the flat web with attachment material 97, such as solder or welds.

Figure 4:
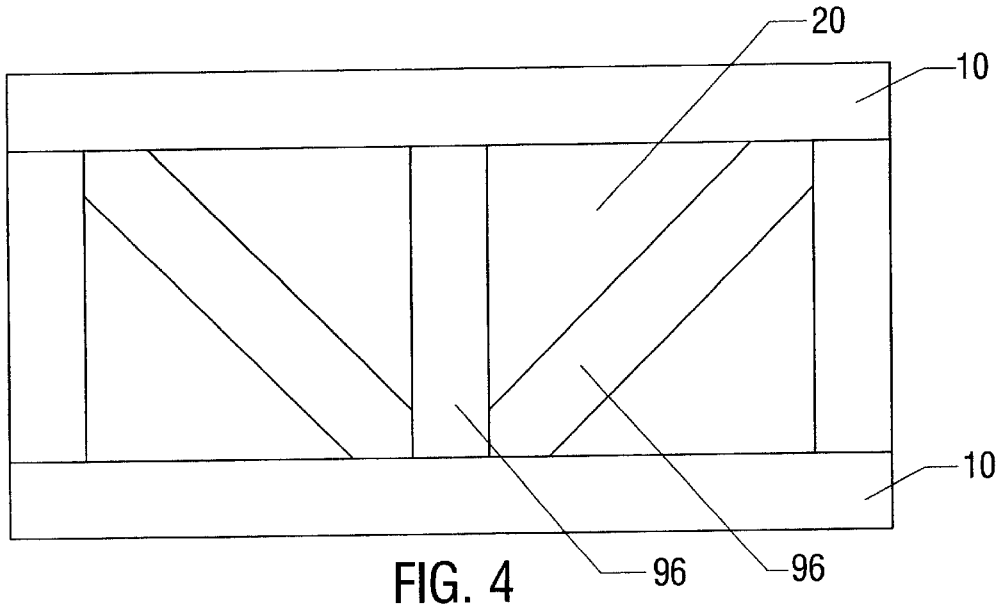
FIG. 4 (Prior Art)
FIG. 4 shows a prior art I-beam having stiffeners.

FIG. 4 shows a side view of a prior art I-beam having stiffeners or flange braces 96 running perpendicular to flanges 10, and angled with respect to flanges 10. As previously described, such stiffeners may add manufacturing costs, improve strength, and increase the weight of the I-beams.

Figure 5:
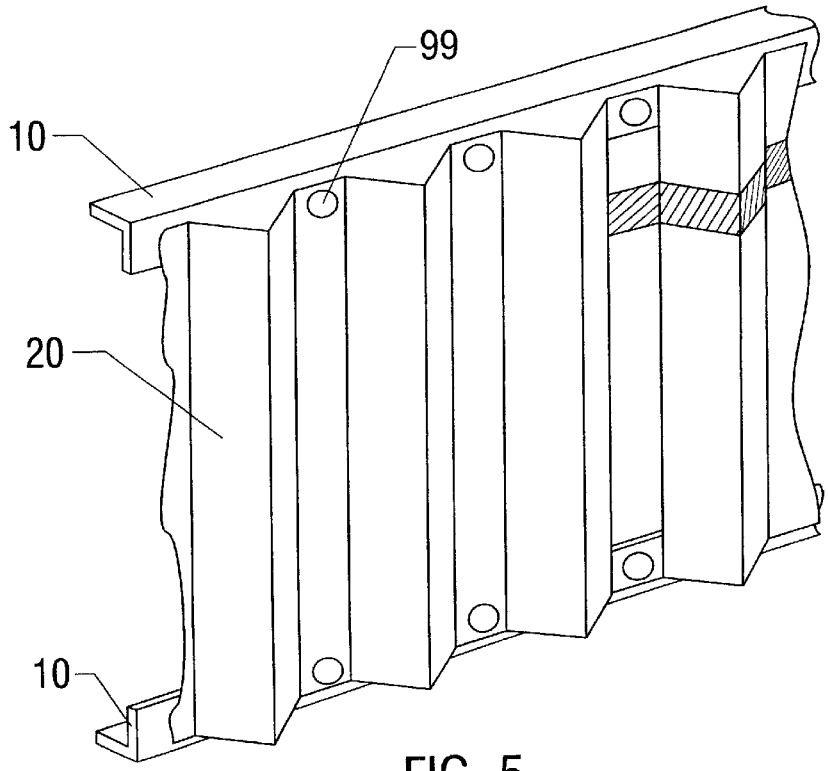
FIG. 5 (Prior Art)
FIG. 5 shows a prior art I-beam having the web discreetly attached to the flanges.

FIG. 5 shows a prior art beam in which a triangularly corrugated web 20 is attached to two right angled flanges 10. The attachment is discreetly performed via the bolts 99. As previously discussed, use of discreet attachment means increases the weight and costs associated with the beam, while reducing the fatigue strength of the beam.

Figure 6:
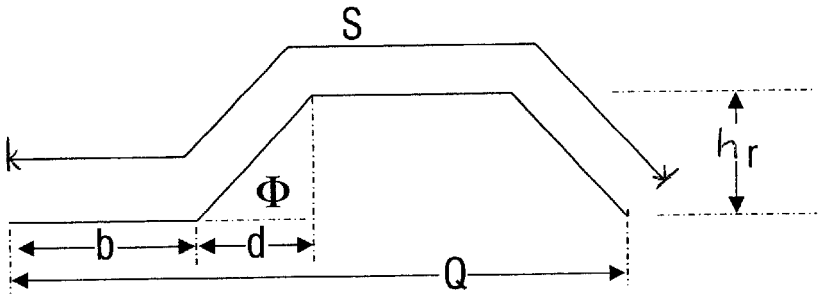
FIG. 6 (Prior Art)
FIG. 6 shows an end view of a prior art corrugation.

FIG. 6 shows the dimensions of a prior art trapezoidal corrugation. Standard dimensions for the lengths of the corrugations, in inches with millimeters in parentheses, are shown in Table 1. For these standard panels, solid rectangular flanges six inches by 0.5 inch thick are used. Web thicknesses 24 gauge (0.0239" or 0.6071 mm) and 22 gauge (0.0299" or 0.7595 mm) are typical.

TABLE 1

| Panel | b | d | h | Ø | s | Q |
|---|---|---|---|---|---|---|
| UFS | 0.78 (19.8) | 0.47 (11.9) | 0.56 (14.2) | 50° | 3.0 (76.2) | 2.5 (63.5) |
| UF1X | 1.50 (38.1) | 1.0 (25.4) | 1.0 (25.4) | 45° | 5.83 (148.1) | 5.0 (127.0) |
| UFX-36 | 1.65 (41.9) | 0.92 (23.4) | 1.31 (33.3) | 55° | 6.5 (165.1) | 5.14 (130.6) |
| UF2X | 1.96 (49.8) | 1.04 (26.4) | 2.0 (50.8) | 62.5° | 8.43 (214.1) | 6.00 (152.4) |

Figure 7:
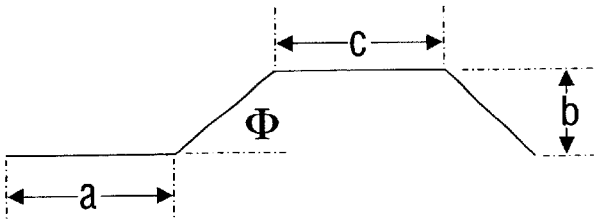
FIG. 7 (Prior Art)
FIG. 7 shows an end view of a prior art corrugation.

FIG. 7 shows the dimensions of another prior art corrugated web having trapezoidal corrugations. The use of corrugated webs alone does improve the strength-to-weight ratio of the beams. However, the solid flanges still add weight to the resulting beams. Dimensions of a trapezoidal corrugation for use with these solid flanges are shown below in Table 2, in inches with millimeters in parentheses. In this prior art, the two sections of the web connecting to the flanges that are parallel to the flanges are not of equal length.

TABLE 2

| a | b | C | Ø | Thickness |
|---|---|---|---|---|
| 0.5 (12.7) | 0.71 (17.96) | 1.0 (25.4) | 45° | 0.0179 (0.45) |
| 0.5 (12.7) | 0.71 (17.96) | 1.0 (25.4) | 45° | 0.0239 (0.61) |
| 0.5 (12.7) | 0.71 (17.96) | 1.0 (25.4) | 45° | 0.0359 (0.91) |
| 0.75 (19.0) | 1.00 (25.4) | 0.75 (19.0) | 50° | 0.299 (0.76) |
| 2.76 (70.0) | 1.97 (50.0) | 5.51 (140.0) | 45° | 0.0827 (2.1) |
| 2.76 (70.0) | 1.97 (50.0) | 5.51 (140.0) | 45° | 0.1024 (2.6) |
| 1.38 (35.0) | 0.59 (15.0) | 2.76 (70.0) | 45° | 0.0394 (1/.0) |
| 3.37 (85.5) | 1.02 (26.0) | 1.34 (34.0) | 63° | 0.0787 (2.0) |
| 2.91 (74.0) | 2.05 (52.0) | 5.83 (148.0) | 45° | 0.0394 (1.0) |
| 0.34 (8.73) | 0.56 (14.3) | 0.69 (17.46) | 45° | 0.0179 (0.45) |

Figure 8A:
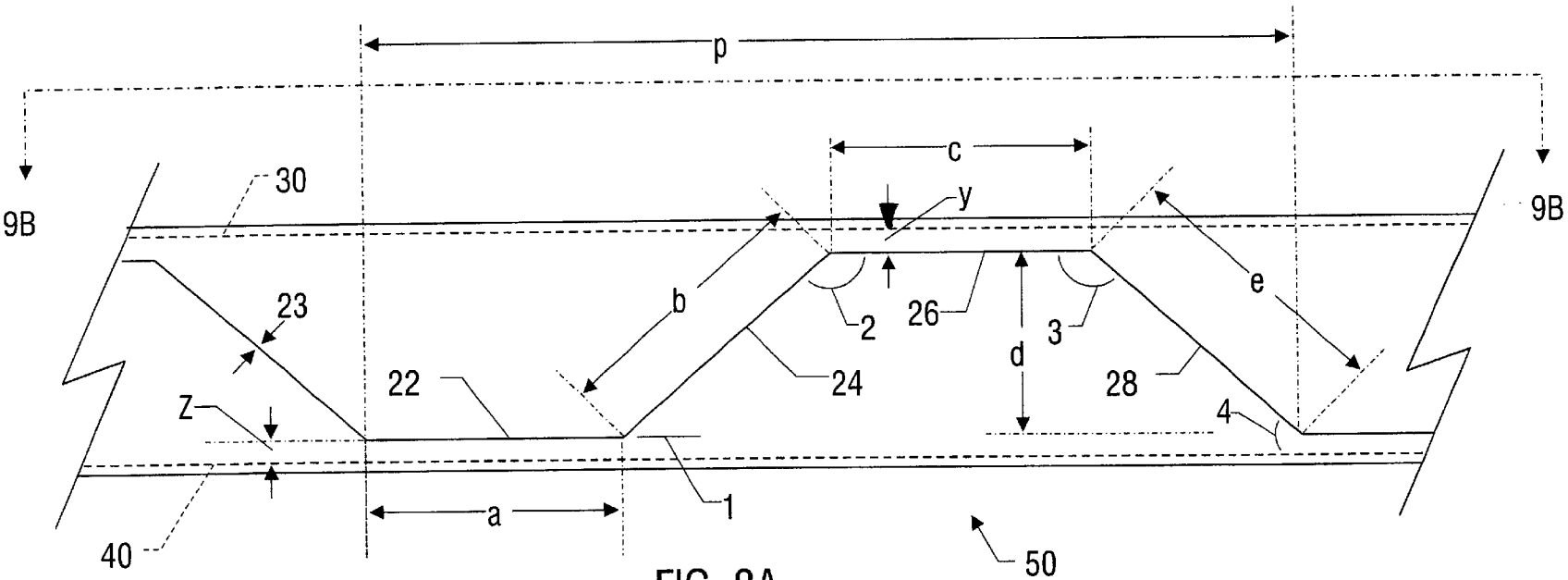
FIGS. 8A–C show an embodiment of the present invention having a trapezoidal web.
Figure 8B:
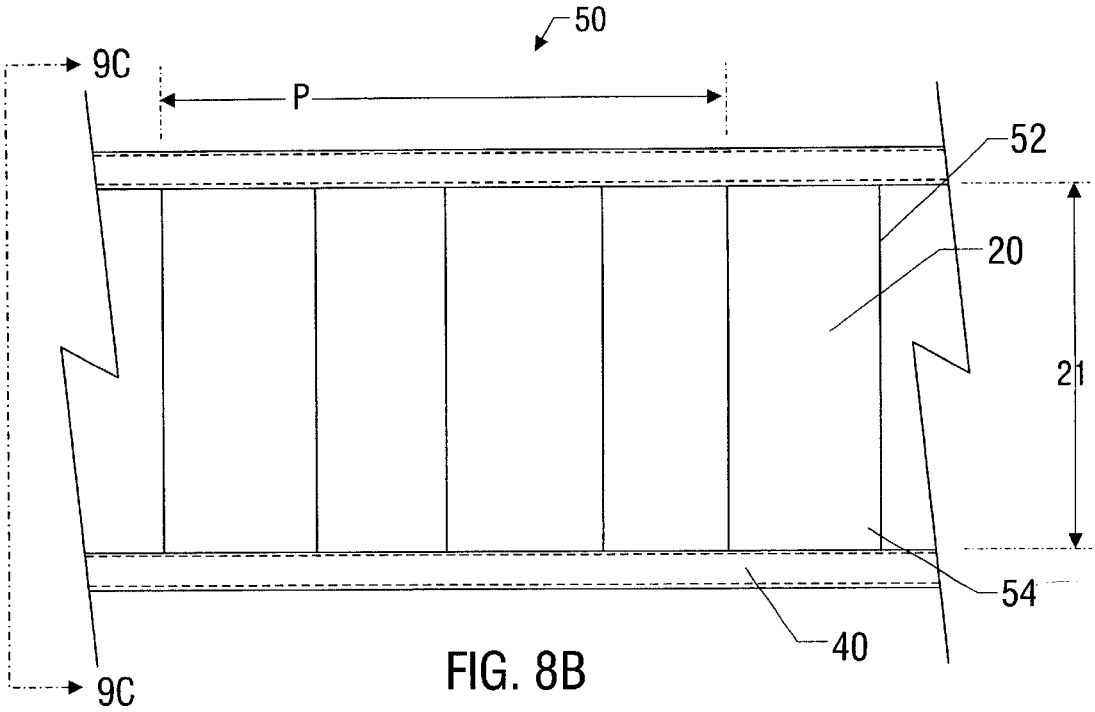
Figure 8C:
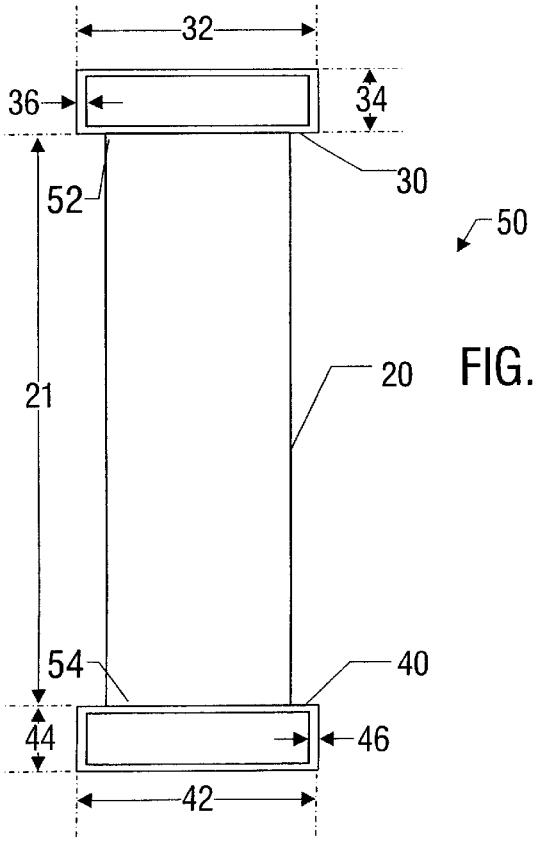

FIGS. 8A–C show one embodiment of the present invention. FIG. 8A represents a cross sectional view, FIG. 8B is a side view, and FIG. 8C is an end view of a structural beam 50 having a corrugated web 20. The structural beam 50 consists of a hollow top section or tube 30. In this embodiment, the top tube is shown having a rectangular cross section. The top tube 30 is shown to have a width 32, a height 34, and a thickness 36.

Similarly, the structural beam 50 of this embodiment of the present invention further comprises a hollow bottom section or tube 40. In this embodiment, the bottom tube is shown having a rectangular cross section. The bottom tube 40 is shown to have a width 42, a height 44, and a thickness 46. The hollow tubes, coupled with the corrugated web, provide the same or higher strength as would solid beams of the same overall dimensions. However, the hollow beams weigh considerably less than their solid counterparts.

Interposed between the top tube 30 and the bottom tube 40 is a corrugated web 20. In this embodiment, the corrugated web is shown to have a profile with a trapezoidal shape as best shown in FIG. 8A. The trapezoidal profile of the web is shown to be comprised of four sections: first section 22, second section 24, third section 26, and fourth section 28. Although not required, in this embodiment the sections 22, 24, 26, and 28 are planer. The lengths of each section is shown as "a", "b", "c", and "e" respectively. Also shown is the depth "d" for the trapezoidal web 20.

The first section 22 forms an angle 1 with second section 24. Second section 24 forms an angle 2 with third section 26. Third section 26 forms an angle 3 with fourth section 28.

This pattern of the four sections is then repeated, at a pitch "P", until the length of the entire trapezoidal profile reaches the desired length of the structural beam 50 to be constructed. Because the pattern repeats, the fourth section 28 forms angle 4 with the repeated first section 22.

As shown in FIG. 8A, the first section 22 is located a distance "z" from an outer parallel edge of the bottom tube 40. Similarly, third section 26 is located a distance "y" from an outer parallel edge of top tube 30. The dimension "z" may or may not be equal to the dimension "y". For the given structural beams herein described, typical dimensions for "y" and "z" can be from 1/16" to up to 12 inches, depending on the depth of the web and the height of the tubes being utilized in a particular embodiment.

While the trapezoidal pattern may be symmetrical, the trapezoidal pattern of this embodiment of the present invention is not restricted to symmetrical configurations in which the length of the first section 22 is equal to the length of the third section 26. Nor the length of the second section 24 necessarily equal to the length of the fourth section 28.

As shown in FIG. 8B, the web 20 has a height 21. Web height 21 is defined as the distance between the top tube 30 and the bottom tube 40. It has been discovered that the greater the height of the web, the greater the contribution of the corrugation to the lateral stability and strength of the web 20, especially when used in conjunction with the rectangular top tube 30 and rectangular bottom tube 40. Although various heights 21 of web 20 may be utilized, exemplary values for web heights are 12 inches, 16 inches, 24 inches, 30 inches, 36 inches, 40 inches, 48 inches, 60 inches, and 72 inches.

The thickness 23 of the web 20 may be 0.083" or 0.12", although other thicknesses may be utilized. For beams constructed with web heights over twenty-four inches, web thickness of 0.12" are generally utilized. For beams having web heights 21 of twenty-four inches or less, web thickness of 0.083" is generally used.

Although other geometries may be utilized, in this embodiment the first section 22 is parallel to the third section 26. Therefore, angle 1 is supplementary to angle 2. Similarly, angle 4 is supplementary to angle 3.

Exemplary dimensions for a trapezoidal corrugation is shown in Table 3.

TABLE 3

| Web Thickness 29 | Web Height 21 | Web Pitch "p" | a | b | c | Web Depth d | e |
|---|---|---|---|---|---|---|---|
| 0.12" | >24" | 27 5/16" | 8" | 8" | 8" | 6 7/16" | 8" |
| 0.083" | < or =24" | 18 1/4" | 5 5/8" | 5" | 5 5/8" | 3 15/16" | 5" |

Corrugated web 20 further comprises a first end 52 and a second end 54. The first end 52 of the corrugated web is attached to the top tube 30. The second end 54 of the corrugated web is attached to the bottom tube. The method of attachment is not limited to any particular type. For instance, the web can be welded to the top and bottom tubes using SMAW, GMAW, GTAW, FCAW, SAW or MIG welding processes known in the art The web may be welded to the top and bottom tubes along the entire length of the trapezoidal profile, on one or both sides of the web. Or the web can be epoxied along the entire length of the trapezoidal profile. Or the web could be soldered in place along the entire length of the trapezoidal profile.

Alternatively, the web may be attached to the tubes in a discreet (non-continuous) fashion by only attaching a portion, or one side, of the web to the top and bottom tubes. The corrugations of the web may be connected to the tubes continuously over the entire length of the web, or discreet, formed only at specific locations along the web. For instance, only the web corrugations parallel to the tubes could be attached to the tubes. Numerous other methods of connection could be utilized by one of ordinary skill in the art having benefit of this disclosure.

Although not restricted to these dimensions, exemplary values for some embodiments of the structural beam 50 of this invention follow: top tube width 32 and bottom tube width 42 typically include four inches, five inches, six inches, eight inches, ten inches, and twelve inches. Top tube height 34 and bottom tube height 44 may include two inches, three inches, four inches, six inches, and eight inches. Top tube thickness 36 and bottom tube 46 typically include 1/4", 1/8", 3/16", 3/8", 5/16", 1/2", 5/8", and 3/4". Further, although any material could be utilized, it is possible to construct structural beams in accordance with the present invention made of stainless steel or aluminum.

The described corrugated beams 50 are economical compared to plane webs with stiffeners of the prior art. For instance, the fabrication costs of these beams 50 are normally considerably lower than those for manufacturing plates with stiffeners. The elimination of the attachment of the stiffeners or flange braces decreases the manufacturing costs considerably.

It has been discovered that by utilizing the corrugated web 20 in conjunction with hollow tubes 30 and 40, each having dimensions as illustrated herein, the resulting beams have a higher strength-to-weight ratio than those of the prior art.

This embodiment of the present invention has been found to be sufficiently strong to eliminate the need to attach stiffeners and most flange braces of the prior art. The elimination of the stiffeners and/or flange braces further decreases the weight of the overall structural beam while maintaining or even increasing the beam's overall strength and resistance to fatigue. Further, these corrugated webs 50 improve the lateral buckling strength of the web and improve thermal stress relief. These corrugated webs 50 provide continuous stiffening which permits use of thinner web material, thus reducing the overall weight of the beam.

Figure 9:
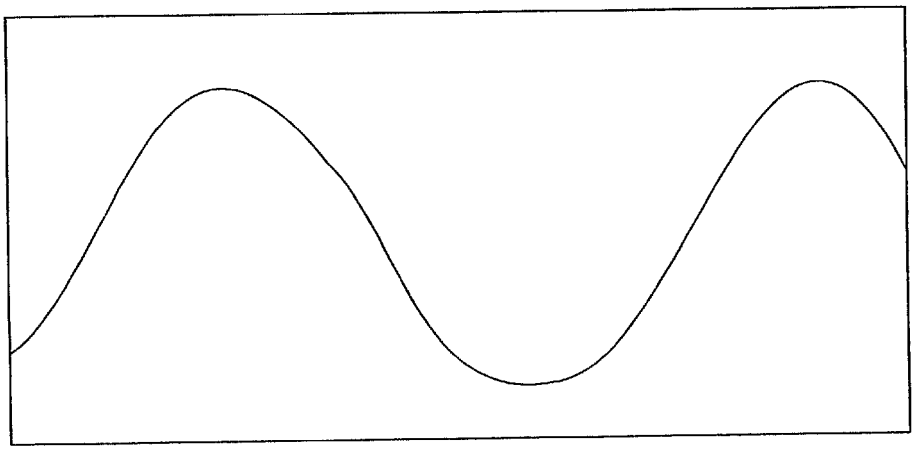
FIG. 9 shows an embodiment of the present invention having a sinusoidal web.

Referring to FIG. 9, other shapes of corrugations may be utilized. For example, a sinusoidal web may be utilized as shown in this figure.

Figure 10:
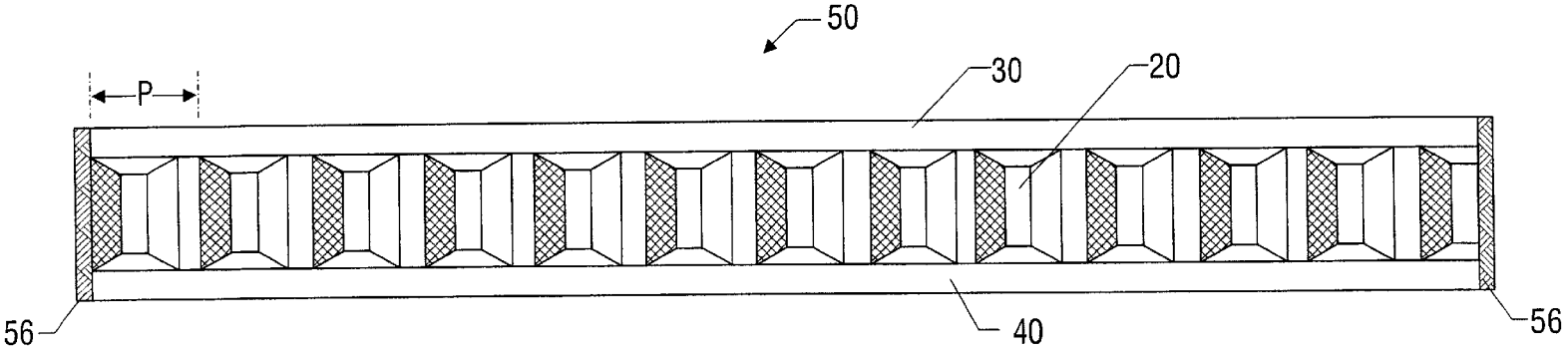
FIG. 10 shows a structural beam of one embodiment of the present invention.

Referring to FIG. 10, a front view of a structural beam 50 of one embodiment of the present invention is shown. In this embodiment, two connecting plates 56 are shown an either end of beam 50. The entire trapezoidal profile is shown comprised of approximately twelve and one half individual trapezoidal patterns consecutively attached.

Figure 11:
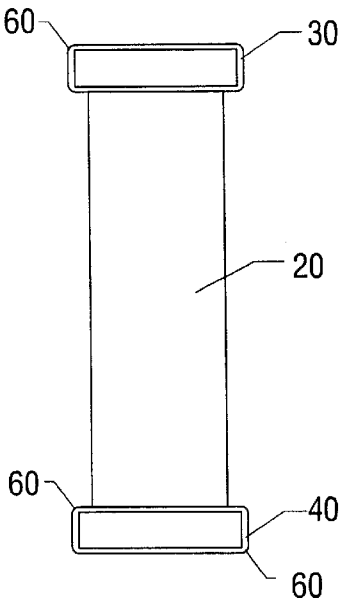
FIG. 11 shows an embodiment of the present invention with tubes having rounded comers.

Referring to FIG. 11, an embodiment of the present invention is shown in which the top tube 30 and the bottom tube 40 have rounded comers 60. Construction of a structure utilizing beams having the rounded comers 60 of the tubes 30 and 40 is less dangerous, as workers are not exposed to sharp beam comers. Further, these rounded edges 60 increase the usefulness of these beams, as the resulting beams are suitable for use that prior art beams with sharp comers were inappropriate, e.g. for use as exposed structural columns for a barn or stable that livestock may contact.

Figure 12A:
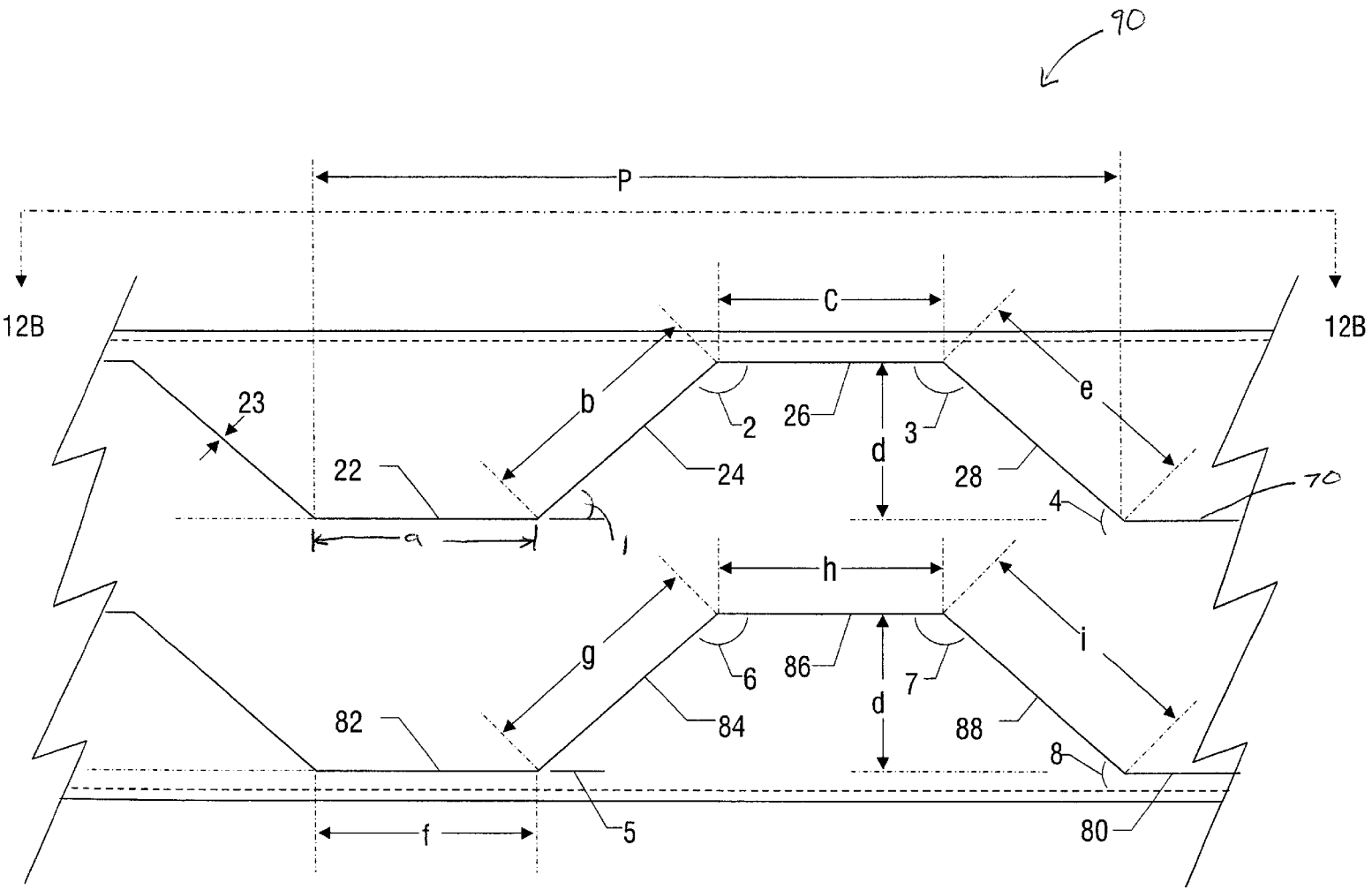
FIGS. 12A–C show an embodiment of the present invention having a a double trapezoidal web.
Figure 12B:
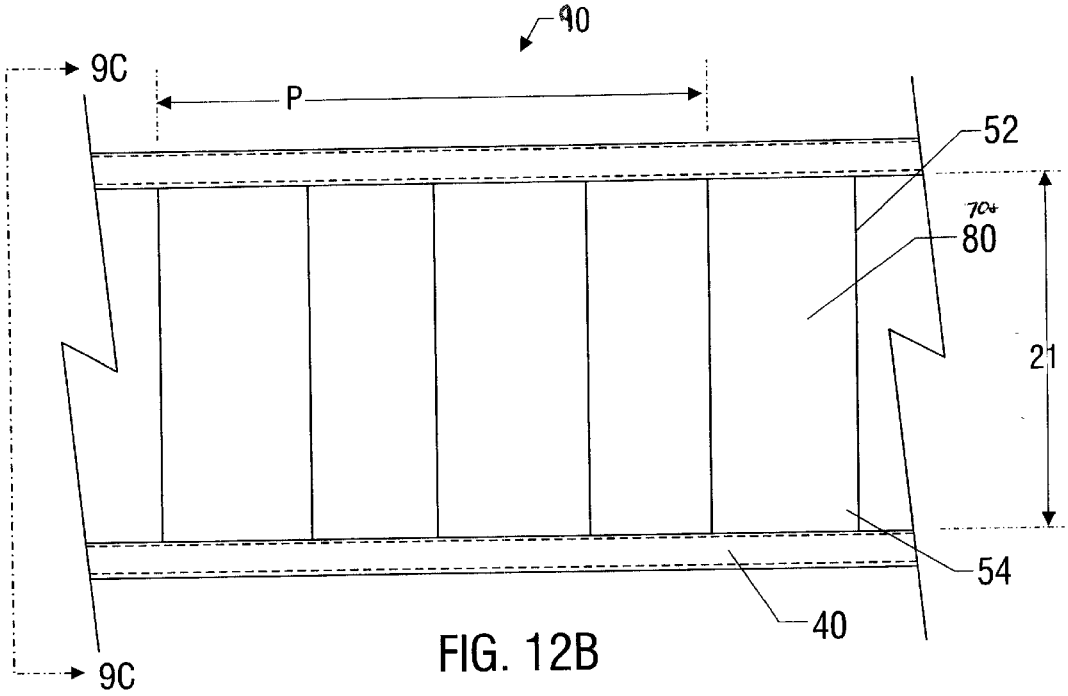
Figure 12C:
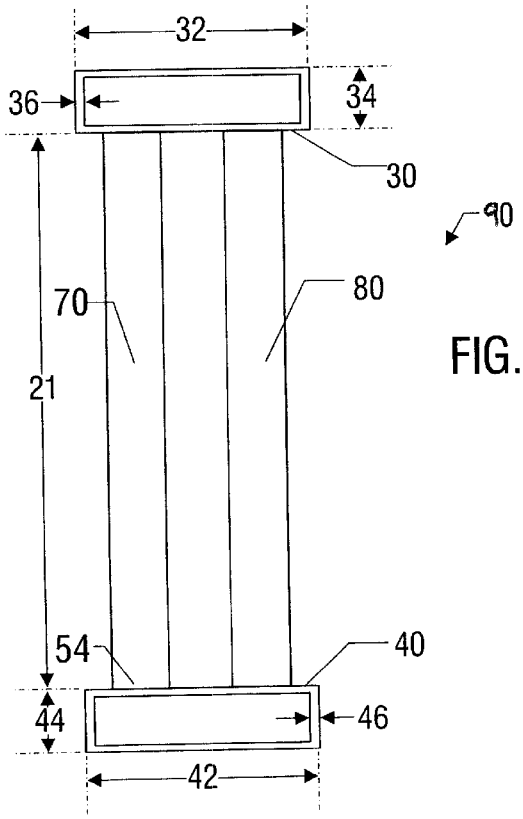

FIGS. 12A–C show another embodiment of the present invention. FIG. 12A represents a cross sectional view, FIG. 12B is a side view, and FIG. 12C is an end view of a double structural beam 90 having a web, in this case corrugated web 70, and a second web, corrugated web 80. The are not necessarily corrugated in this embodiment of the present invention. The double structural beam 90 consists of a hollow top section or tube 30. In this embodiment, the top tube is shown having a rectangular cross section. The top tube 30 is shown to have a width 32, a height 34, and a thickness 36.

Similarly, the structural beam 90 of this embodiment of the present invention further comprises a hollow bottom section or tube 40. In this embodiment, the bottom tube 40 is shown having a rectangular cross section. The bottom tube 40 is shown to have a width 42, a height 44, and a thickness 46. The hollow tubes 30 and 40, coupled with the webs 70 and 80, provide the same or higher strength as would solid beams of the same overall dimensions. However, the hollow beams weigh considerably less than their solid counterparts.

Interposed between the top tube 30 and the bottom tube 40 is a web, here corrugated web 70, and a second web, here a corrugated web 80. In this embodiment, the corrugated webs 70 and 80 are shown to have profiles with a trapezoidal shape as best shown in FIG. 12A. The trapezoidal profile of the web 70 are shown to be comprised of four sections: first section 22, second section 24, third section 26, and fourth section 28. The trapezoidal profile of the second web 80 are shown to be comprised of four sections: first section 82, second section 84, third section 86, and fourth section 88.

Although not required, in this embodiment the sections 22, 24, 26, 28, 82. 84, 86, and 88 are planer. The lengths of each section is shown as "a", "b", "c", "e", "f", "g", "h", and "i" respectively. Also shown is the depth "d" for the trapezoidal webs 70 and 80.

For the web 70, the first section 22 forms an angle 1 with second section 24. Second section 24 forms an angle 2 with third section 26. Third section 26 forms an angle 3 with fourth section 28. Similarly, for the second web 80, the first section 82 forms an angle 5 with second section 84. Second section 84 forms an angle 6 with third section 86. Third section 86 forms an angle 7 with fourth section 88.

This pattern of the four sections is then repeated, at a pitch "P", until the length of the entire trapezoidal profile reaches the desired length of the structural beam 90 to be constructed. Because the pattern repeats, the fourth sections 28 and 88 form angle 4 and 8 with the repeated first section 22 and 82, respectively.

While the trapezoidal pattern may be symmetrical, the trapezoidal pattern of this embodiment of the present invention is not restricted to symmetrical configurations in which the length of the first section 22 or 82 is equal to the length of the third section 26 or 86. Nor the length of the second section 24 or 84 necessarily equal to the length of the fourth section 28 or 88.

Further, although the web 70 is shown to be parallel to second web 80, the invention is not so limited. For instance, web 70 may be a mirror image of second web 80. Or web 70 may be out of phase with second web 80 by ¼ pitch "P". Or the dimensions of web 70 may be unrelated to the dimension of second web 80.

As shown in FIG. 12B, the webs 70 and 80 have a height 21. Web height,21 is defined as the distance between the top tube 30 and the bottom tube 40. It has been discovered that the greater the height of the web, the greater the contribution of the corrugation to the lateral stability and strength of the webs 70 and 80, especially when used in conjunction with the rectangular top tube 30 and rectangular bottom tube 40. Although various heights 21 of the webs 70 and 80 may be utilized, exemplary values for web heights are 12 inches, 16 inches, 24 inches, 30 inches, 36 inches, 40 inches, 48 inches, 60 inches, and 72 inches.

The thickness 23 of the web 20 may be 0.083" or 0.12", although other thicknesses may be utilized. For beams constructed with web heights over twenty-four inches, web thickness of 0.12" are generally utilized. For beams having web heights 21 of twenty-four inches or less, web thickness of 0.083" is generally used.

Although other geometries may be utilized, in this embodiment for web 70 the first section 22 is parallel to the third section 26. Therefore, angle 1 is supplementary to angle 2. Similarly, angle 4 is supplementary to angle 3. Similarly, for web 80, the first 10 section 82 is parallel to the third section 86. Therefore, angle 5 is supplementary to angle 6. Similarly, angle 8 is supplementary to angle 7.

Exemplary dimensions for a trapezoidal corrugation is shown in Table 4.

TABLE 4

| Web Thickness 29 | Web Height 21 | Web "p" Pitch | a or f | b or g | c or h | Web Depth d | e or i |
|---|---|---|---|---|---|---|---|
| 0.12" | >24" | 27 5/16" | 8" | 8" | 8" | 6 7/16" | 8" |
| 0.083" | < or =24" | 18 ¼" | 5 ⅝" | 5" | 5 ⅝" | 3 15/16" | 5" |

Corrugated webs 70 and 80 further comprise a first end 52 and a second end 54. The first end 52 of the corrugated web is attached to the top tube 30. The second end 54 of the corrugated web is attached to the bottom tube. The method of attachment is not limited to any particular type. For instance, the webs can be welded to the top and bottom tubes using SMAW, GMAW, GTAW, FCAW, SAW or MIG welding processes known in the art The webs may be welded to the top and bottom tubes along the entire length of the trapezoidal profile, on one or both sides of the webs. Or the webs can be epoxied along the entire length of the trapezoidal profile. Or the webs could be soldered in place along the entire length of the trapezoidal profile.

Alternatively, the webs may be attached to the tubes in a discreet (non-continuous) fashion by only attaching a portion, or one side, of the web to the top and bottom tubes. The corrugations of the webs may be connected to the tubes continuously over the entire length of the web, or discreet, formed only at specific locations along the web. For instance, only the web corrugations parallel to the tubes could be attached to the tubes. Numerous other methods of connection could be utilized by one of ordinary skill in the art having benefit of this disclosure.

Although not restricted to these dimensions, exemplary values for some embodiments of the structural beam 50 of this invention follow: top tube width 32 and bottom tube width 42 typically include four inches, five inches, six inches, eight inches, ten inches, and twelve inches. Top tube height 34 and bottom tube height 44 may include two inches, three inches, four inches, six inches, and eight inches. Top tube thickness 36 and bottom tube 46 typically include ¼", ⅛", 3/16", ⅜", 5/16", ½", ⅝", and ¾". Further, although any material could be utilized, it is possible to construct structural beams in accordance with the present invention made of stainless steel or aluminum.

The described corrugated beams 50 are economical compared to plane webs with stiffeners of the prior art. For instance, the fabrication costs of these beams 50 are normally considerably lower than those for manufacturing plates with stiffeners. The elimination of the attachment of the stiffeners or flange braces decreases the manufacturing costs considerably.

It has been discovered that by utilizing the corrugated web 20 in conjunction with hollow tubes 30 and 40, each having dimensions as illustrated herein, the resulting beams have a higher strength-to-weight ratio than those of the prior art.

The structural beams previously described may be utilized in a myriad of ways. For instance, the structural beams may be used as columns to provide vertical support in a building, with one end of the column being placed in the ground and the other end of the column supporting a building's roof or a floor. Similarly, the structural beams can be used as a truss to provide lateral support, such being laterally placed between two vertical walls.

All of the apparatuses and methods disclosed and claimed herein can be made and executed without undue experimentation in light of the present disclosure. While the apparatuses and methods of this invention have been described in terms of preferred embodiments, it will be apparent to those of skill in the art that variations may be applied to the methods and/or apparatuses and in the steps or in the sequence of steps of the method described herein without departing from the concept, spirit and scope of the invention. All such similar modifications apparent to those skilled in the art are deemed to be within the spirit, scope and concept of the invention as defined by the appended claims.

What is claimed is:

1. A structural beam comprising:

a top tube having a first rectangular cross section;

a bottom tube having a second rectangular cross section; and a corrugated web having a first end and a second end, the corrugated web being interposed between the top and the bottom tube, the first end of the corrugated web being connected to the top tube, the second end of the corrugated web being connected to the bottom tube.

2. The structural beam of claim 1 in which the first and second rectangular cross sections each have a wall thickness of between about ⅛ inch and about ¾ inch.

3. The structural beam of claim 1 in which the wall thickness of the first and second rectangular cross section is ⅛ inch.

4. The structural beam of claim 1 in which the first and second rectangular cross sections each have a width of between about four inches to about twelve inches and a height of between one inch and eight inches.

5. The structural beam of claim 1 in which the width of each rectangular cross section is four inches.

6. The structural beam of claim 1 in which the height of each rectangular cross section is between about two inches and about eight inches.

7. The structural beam of claim 1 in which the height of each rectangular cross section is two inches.

8. The structural beam of claim 1 in which the corrugated web further comprises a sinusoidal profile.

9. The structural beam of claim 1 in which the corrugated web further comprises a trapezoidal profile.

10. The structural beam of claim 9 in which the trapezoidal profile further comprises:

a first section;

a third section parallel to the first section;

a second section connected to the third section at a first angle, the second section connected to the first section at a second angle supplementary to the first angle; and a fourth section connected to the third section at a third angle.

11. The structural beam of claim 10 in which the first section has a length substantially equal to a length of the third section.

12. The structural beam of claim 10 in which the first section has a length between about five inches and about nine inches.

13. The structural beam of claim 10 in which the length of the first section is five ⅝ inches.

14. The structural beam of claim 10 in which the first, second, third, and fourth sections each have a web height being defined the distance between the hollow top and hollow bottom plate of between about twelve inches and about seventy two inches.

15. The structural beam of claim 10 in which the web height is twelve inches.

16. The structural beam of claim 10 in which the first angle is substantially the same as the second angle.

17. The structural beam of claim 10 in which the trapezoidal profile repeats at a pitch.

18. The structural beam of claim 17 in which the pitch of the trapezoidal profile is 18¼ inches .

19. The structural beam of claim 10 in which the web has a web thickness of between about 0.08 inch and about 0.12 inch.

20. The structural beam of claim 10 in which the web thickness is 0.083 inches.

21. The structural beam of claim 10 in which the second section has a length between about five inches and about nine inches.

22. The structural beam of claim 10 in which the length of the second section is five inches.

23. The structural beam of claim 10 in which the third section has a length between about five inches and about nine inches.

24. The structural beam of claim 10 in which the length of the third section is 5⅝ inches.

25. The structural beam of claim 10 in which the fourth section has a length between about three inches and about eight inches.

26. The structural beam of claim 10 in which the length of the fourth section is five inches.

27. The structural beam of claim 10 in which the first section of the corrugated web is located a distance of about 1/32" and about twelve inches from an outer parallel edge of the top tube.

28. The structural beam of claim 27 in which the first section of the corrugated web is located a distance of 1 1/32" from the outer parallel edge of the top tube.

29. The structural beam of claim 1 further comprising:

a second web having a first end and a second end, the second web being interposed between the top tube and the bottom tube, the first end of the second web being connected to the top tube, the second end of the second web being connected to the bottom tube.

30. The structural beam of claim 29 in which the web and the second web are corrugated.

31. The structural beam of claim 30 in which the corrugation web and the second corrugated web each comprise a trapezoidal profile.

32. The structural beam of claim 31 in which the trapezoidal profile of the web and the second web further comprise:

a first section;

a third section parallel to the first section;

a second section connected to the third section at a first angle, the second section connected to the first section at a second angle supplementary to the first angle; and a fourth section connected to the third section at a third angle.

33. The structural beam of claim 10 in which the first end of the web is welded to the top tube, the second end of the web being welded to the bottom tube.

34. The structural beam of claim 10 in which the first end of the web is epoxied to the top tube, the second end of the web being epoxied to the bottom tube.

35. The structural beam of claim 10 in which the first end of the web is connected to the top tube by a first angle iron, the second end of the web being connected to the bottom tube with a second angle iron.

36. A method of constructing a structural beam, the method comprising:

providing a rectangular top tube;

providing a rectangular bottom tube;

providing a web having a first end and a second end;

attaching the first end of the web to the rectangular top tube; and attaching the second end of the web to the rectangular bottom tube such that the web is interposed between the rectangular top tube and the rectangular bottom tube.

37. The method of claim 36 further comprising:

welding the first end of the web to the rectangular top tube; and welding the second end of the web to the rectangular bottom tube.

38. A structural beam comprising:

a top tube having a rectangular cross section, the top tube having a wall thickness of about ¼", the rectangular cross section of the top tube having a width of about four inches, the rectangular cross section of the top tube having a height of about two inches;

a bottom tube having a rectangular cross section, the bottom tube having a wall thickness of about ¼", the rectangular cross section of the bottom tube having a with of about four inches, the rectangular cross section of the bottom tube having a height of about two inches; and a corrugated web having a trapezoidal profile, a first end, and a second end, the web being interposed between the top tube and the bottom tube, the first end of the web being connected to the top tube, the second end of the web being connected to the bottom tube, the trapezoidal profile having a first section with of length of about 5⅝ inches, a third section with a length of about 5⅝ inches parallel to the first section, a second section with a length of about 5 inches connected to the third section at a first angle, the second section connected to the first section at a second angle supplementary to the first angle, and a fourth section having a length of about 5 inches connected to the third section at a third angle, the web having a height of 12 inches, the web having a thickness of 0.083", the first end of the web being welded to the top tube, the second end of the web being welded to the bottom tube.

* * * * *